United States Patent [19]

Bergt

[11] 4,105,063

[45] Aug. 8, 1978

[54] SPACE AIR CONDITIONING CONTROL SYSTEM AND APPARATUS

[75] Inventor: Carl Bergt, Tyler, Tex.

[73] Assignee: General Electric Company, Louisville, Ky.

[21] Appl. No.: 791,364

[22] Filed: Apr. 27, 1977

[51] Int. Cl.[2] ..... F24F 3/14

[52] U.S. Cl. ..... 165/21; 62/176 E; 236/44 C; 236/44 R; 165/3

[58] Field of Search ..... 165/21, 3; 236/44 C, 236/44 R; 62/176 E; 73/335

[56] References Cited

U.S. PATENT DOCUMENTS

| | | | |
|---|---|---|---|
| 3,128,158 | 4/1964 | Colvin | 236/44 R |
| 3,352,352 | 11/1967 | Walters | 165/21 X |
| 3,694,925 | 10/1972 | Coyle et al. | 165/21 X |
| 3,786,859 | 1/1974 | Day | 165/21 |
| 3,989,097 | 11/1976 | Schildknecht | 165/21 |

*Primary Examiner*—Charles J. Myhre
*Assistant Examiner*—Margaret A. LaTulip
*Attorney, Agent, or Firm*—Frank P. Giacalone; Francis H. Boos

[57] ABSTRACT

In an air conditioning system for selectably heating and cooling an enclosed space under control of a room thermostat, dew point temperature of ambient air in the space is maintained below a preselected maximum value by modified use of the heating and cooling apparatus without separate humidity control. For this purpose the cooling apparatus is controlled by a sensor responsive to absolute moisture content in parallel with the normal thermostat control. Energy is further conserved by night set-back of the thermostat with cooling apparatus normally disabled in night set-back.

17 Claims, 5 Drawing Figures

Figures 1, 4:
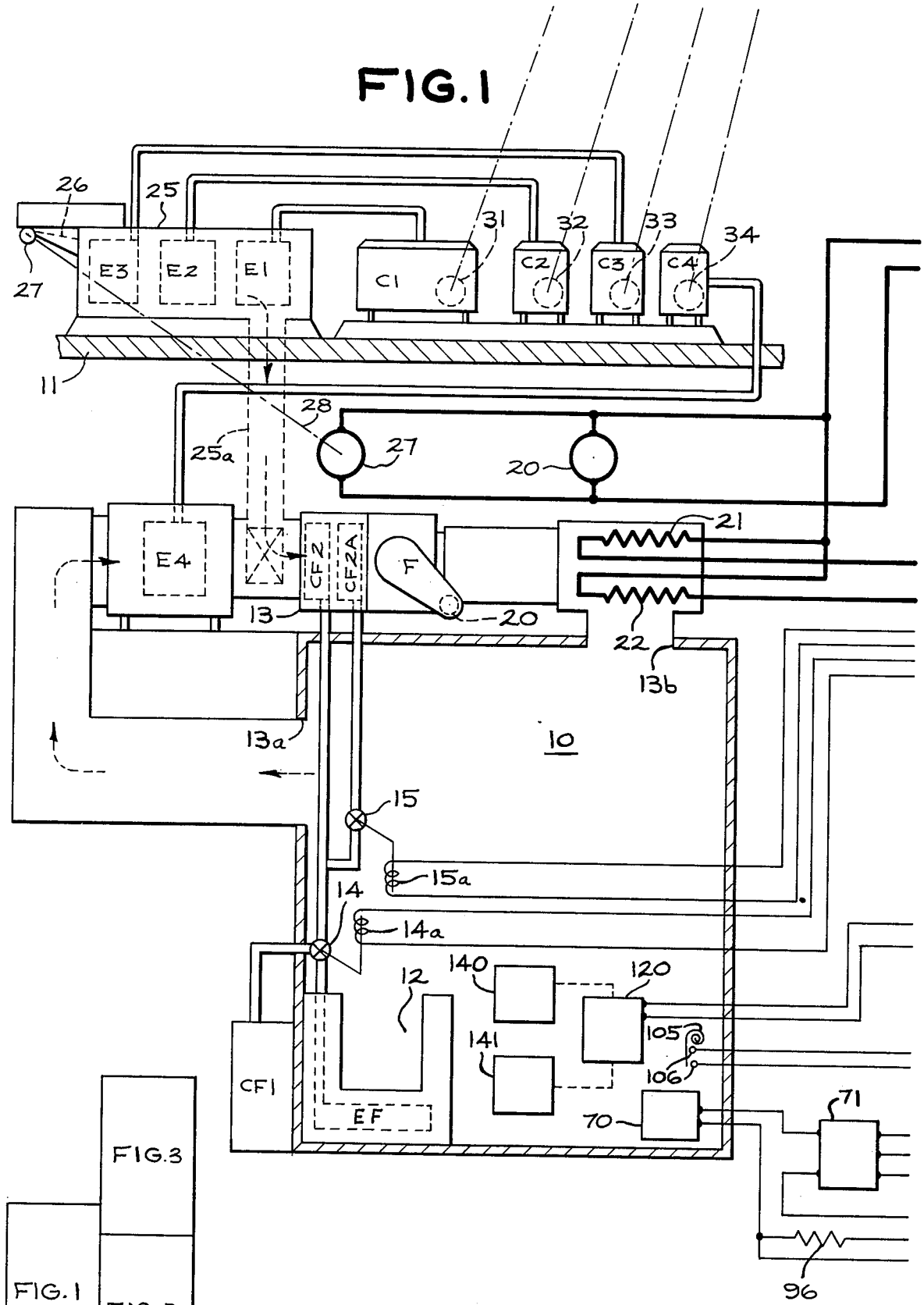

L2
L1
31
32
33
34
80
81
82
83
C1
C2
C3
C4
CS
DS
78
55
77
76
75
56
57
123
60
122
121
61
62
48
47
46
45
41
42
43
44
40
P
T1
T
T2

SPACE AIR CONDITIONING CONTROL SYSTEM AND APPARATUS

My invention relates generally to space air conditioning control systems and apparatus; more particularly it relates to methods and apparatus for controlling temperature and humidity in an air conditioned space which contains separately cooled condensing surfaces, such as cooling or freezing equipment not subject to control by the space air conditioning apparatus.

The invention is especially applicable to supermarkets and the like where it maintains ambient conditions which reduce condensation on open freezers and other refrigerated display equipment. Such ambient conditions enable a reduction in the amount of energy heretofor used to defrost cooling coils and eliminate condensation on refrigerated display cases.

Modern supermarkets ordinarily are provided with space heating and cooling apparatus controlled in accordance with dry bulb room temperature and include a large number of open top freezers and other refrigerated display cases. In humid ambient conditions such freezers and other display cases present many cooled surfaces upon which moisture may condense, remaining as liquid or "sweat" on casing exteriors and freezing to form "frost" on evaporator coils. In the past excessive condensation has been dealt with by frequent defrosting of evaporator coils and by the provision of surface heaters beneath exterior surfaces to prevent sweating. It is also common to supply larger freezer compressors than otherwise would be needed, thereby to overcome the inefficiency of evaporator coils heavily coated with frost. Such large compressors maintain lower evaporator temperatures than needed and thus build up frost even faster. All these techniques require the expenditure of substantial amounts of energy to overcome evaporator inefficiency, to defrost evaporator coils frequently and to heat display case surfaces.

It has been suggested that energy thus wasted may be conserved by controlling humidity to maintain ambient air relatively dry and thus reduce condensation. However, as a separate control system dehumidification requires additional apparatus and utilizes considerable energy to change the moisture content independently of the air cooling and heating apparatus.

Accordingly, it is a general object of my invention to minimize condensation on independently cooled surfaces in an air conditioned space by so controlling the dew point temperature that it does not exceed a predetermined acceptable maximum value.

It is a further object of my invention to provide such dew point temperature control by utilization of existing space heating and cooling apparatus without the need for additional humidity control apparatus.

Thus, it is also an object of my invention to provide a method for operating conventional space heating and cooling apparatus to maintain dew point temperature at or below a predetermined acceptable maximum value.

Still another object of my invention is to provide a method for operating space heating and cooling apparatus in a night set-back, or unoccupied, mode which does not require a reduction of humidity to minimize condensation on refrigerated surfaces.

In carrying out my invention in one preferred embodiment for controlling the condition of ambient air in a conditioned space, I provide a plurality of cooling units and a plurality of heating units, each sequentially actuated in response to deviation of room temperature from a predetermined desired value. Additionally, I provide means for sensing absolute moisture content of the ambient air (i.e. weight of water vapor per pound of dry air) and so controlling the cooling units that absolute moisture content is maintained below a predetermined maximum value.

In operating such apparatus in a night set-back mode the set point of the normal room temperature control is reduced, but the cooling apparatus is also disabled. Preferably, separate room temperature responsive control is operable in the set-back mode to re-enable the cooling apparatus at a selected temperature appreciably above the room temperature set point in the occupied or daytime mode.

Figure 2:
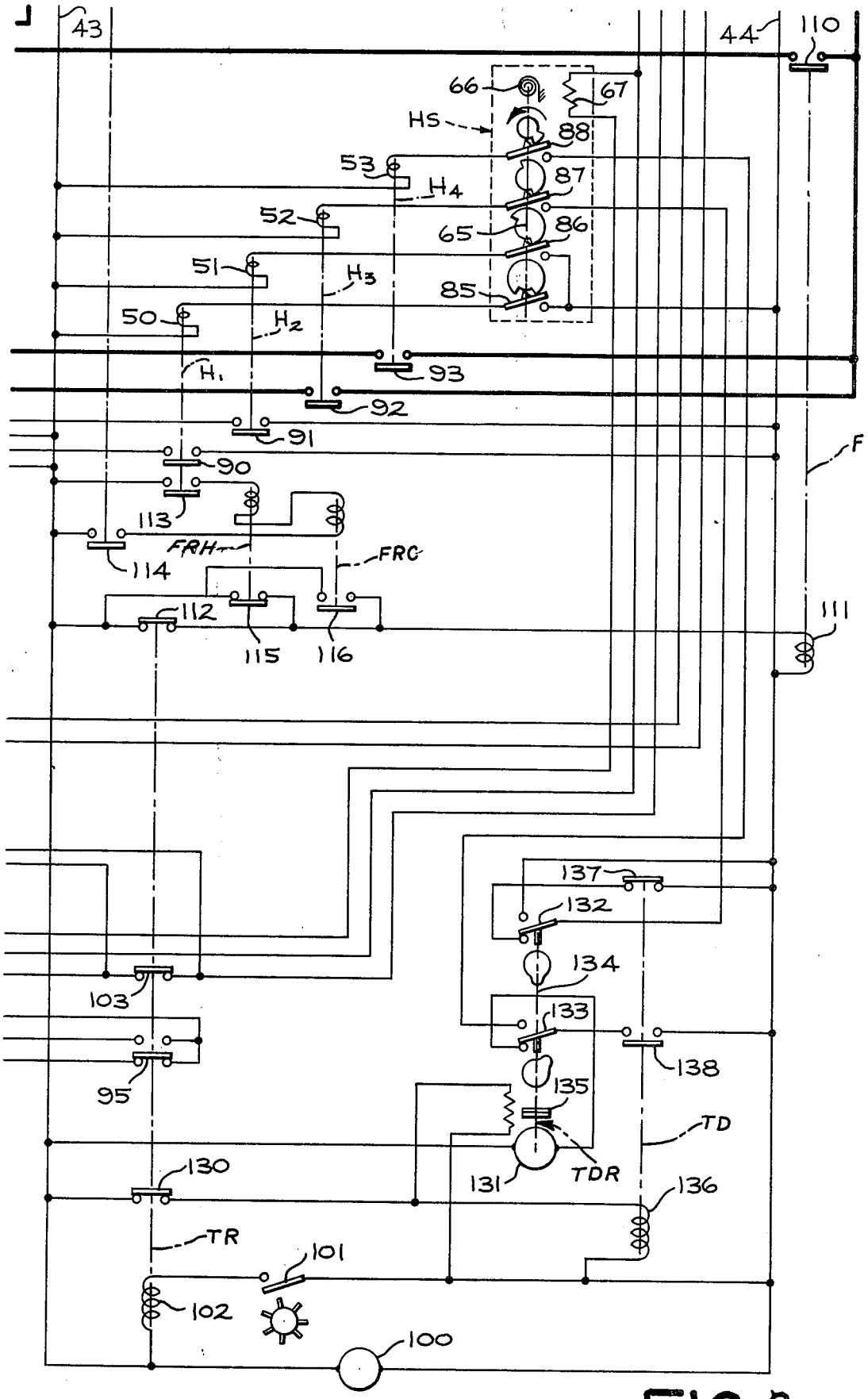
Figure 3:
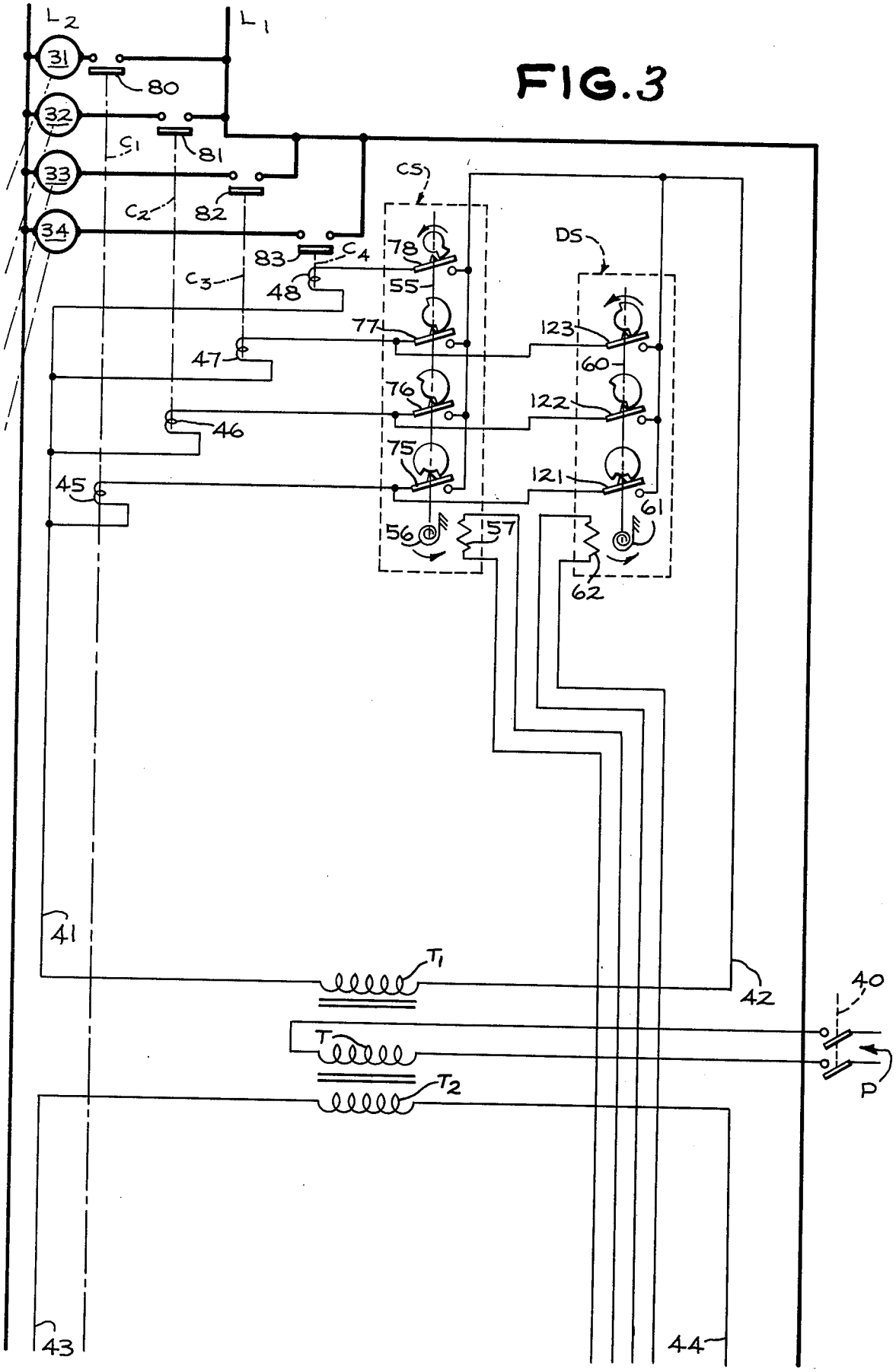
Figure 5:
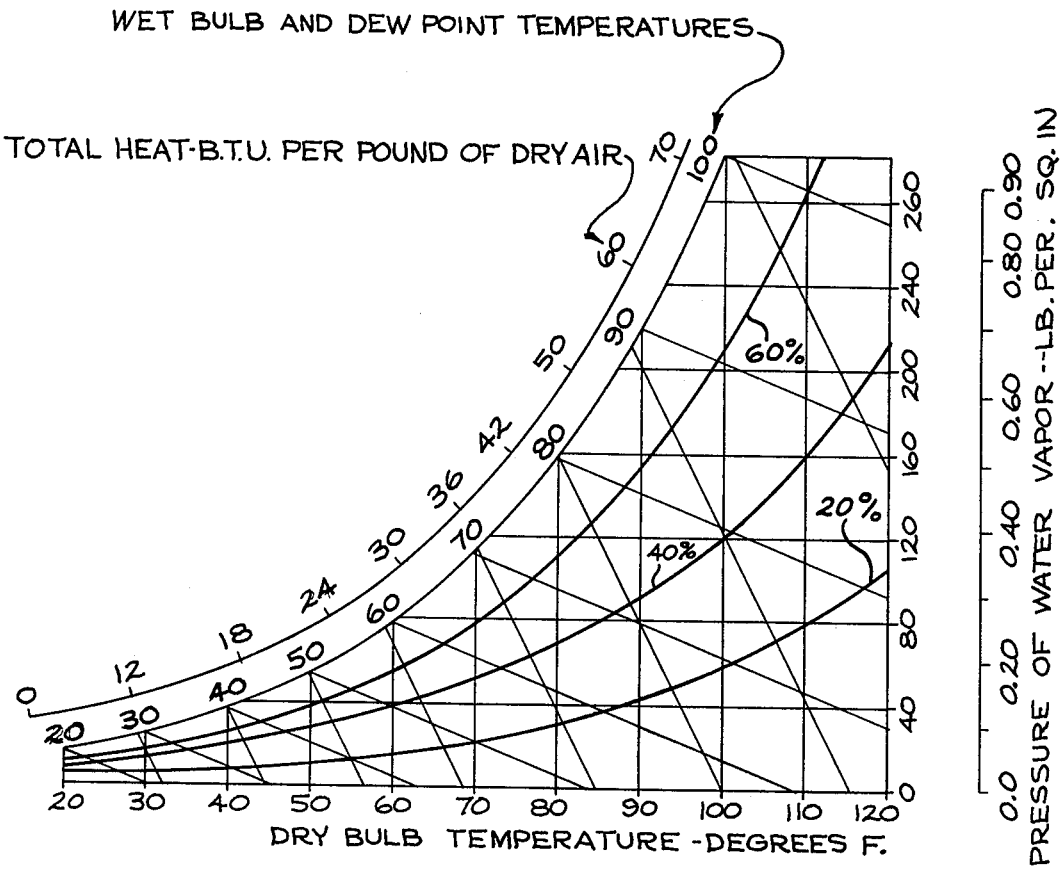

My invention will be more fully understood and its several objects and advantages further appreciated by referring now to the following detailed specification taken in conjunction with the accompanying drawing in which:

FIGS. 1, 2, and 3 together form a schematic circuit diagram of an air conditioning control system for a conditioned space which contains independently controlled refrigerating equipment, FIG. 4 is a schematic diagram indicating the manner in which FIGS. 1, 2 and 3 are combined to form the complete circuit diagram of the system, and FIG. 5 is a graphical representation of the relationship of room temperature, humidity, moisture content and related parameters of ambient air in a conditioned space.

Referring now to the drawing, and particularly to FIGS. 1–3, I have shown a conditioned space 10, such as an insulated room, within a building having a roof 11. The space 10 contains one or more refrigerators, shown illustratively as an open-top food freezer 12, controlled independently of apparatus for heating, cooling or otherwise conditioning ambient air in the space 10. The freezer 12 includes an evaporator EF within the freezing compartment and a compressor-condenser unit CF 1 located outside the conditioned space 10, and either inside or outside the building. A two section refrigerant condenser CF 2, CF 2A located in an air recirculating duct 13 associated with the condition space 10 is adapted to be alternatively connected, in whole or in part, to the freezer evaporator EF through a selector valve 14. A selector valve 15 associated with the sectional condenser CF 2, CF 2A is connected to enable or disable the condenser section CF 2A.

The air recirculating duct 13 extends between an inlet port **13*a* and an outlet port 13*b*. In addition to the sectional heat transfer condenser CF 2, CF 2A the duct 13 has mounted therein a circulating fan F driven by a motor 20, a plurality of supplemental heat generating devices such as electric heaters 21, 22, and an air cooling evaporator E4 associated with a compressor-condenser unit C4 mounted outside the building on the roof 11**.

Also mounted upon the roof 11 I provide a fresh air inlet duct 25 having an inlet port controlled by a pivoted damper 26 and an outlet port connected by a conduit **25*a* to the recirculating duct 13 on the inlet side of the fan F. The outdoor air duct 25 contains a plurality of air cooling evaporators E1, E2, E3, associated, respectively, with separate compressor-condenser units C1, C2, C3 mounted outside the building upon the roof 11. The compressors of the units C1, C2, C3 and C4 are driven, respectively, by compressor motors 31, 32, 33, 34, shown schematically connected thereto by broken lines. Opening and closing of the outside air duct damper 26 is controlled by a motor 27, shown schematically connected thereto by a broken line 28**.

The several compressor motors 31, 32, 33, 34, the supplementary heaters 21, 22 and the fan and damper motors 20 and 27 are all energized through associated starting contactors from a suitable source of electric current supply including a pair of power line conductors L1, L2. As shown at FIG. 3, the compressor motors 31, 32, 33, 34 are energized, respectively through contactors, $C_1$, $C_2$, $C_3$, and $C_4$. In like manner a group of heating contactors $H_1$, $H_2$, $H_3$, and $H_4$, control, respectively, the solenoids 14*a* and 15*a* associated with the selector valves 14, 15, and the supplemental heaters 22, 21. A fan contactor F, when actuated, energizes the fan motor 20 and simultaneously energizes the damper motor 27 to open the damper 26.

The heating contactors, the cooling contactors and other control apparatus to be described hereinafter are all controlled in accordance with ambient air conditions in the space 10 and are energized from a source of control power P through a manually operable control switch 40. As illustrated, the control switch 40, when closed, energizes a control transformer T having secondary windings T-1 and T-2. The winding T-1 is connected to supply control power to a first pair of control conductors 41, 42 for energizing the cooling contactors $C_1$, $C_2$, $C_3$, $C_4$; the winding T-2 is connected to supply control power to a second pair of control conductors 43, 44 for energizing the heating contactors $H_1$, $H_2$, $H_3$, $H_4$, and other control apparatus to be described hereinafter.

The cooling contactors $C_1 - C_4$ are provided, respectively, with actuating windings 45, 46, 47, 48, connected to be energized sequentially, or progressively, through the control contacts of a cooling sequence controller CS. The windings 45, 46, 47 of cooling contactors $C_1$, $C_2$, and $C_3$ are connected to be energized alternatively through the control contacts of a dew point sequence controller DS. In like manner the heating contactors $H_1 - H_4$ are provided, respectively, with actuating winding 50, 51, 52 and 53 connected to be energized sequentially, or progressively, through the control contacts of a heating sequence controller HS. Each of the sequence controllers CS, DS and HS is shown, by way of illustration, as comprising a plurality of control switches sequentially actuated by a rotatable camshaft, an electric heater and a spiral bimetal connected to displace the camshaft angularly from an initial position to an extent proportional to heater energizing current. Specifically, the cooling sequence controller CS comprises a camshaft 55 angularly movable by a spiral bimetal 56 from a de-energized zero position through an angle proportionate to the degree of energization of an electric heating coil 57, the direction of rotation when energized being indicated by an arrow on the drawing. Similarly, the dew point sequence controller DS comprises a camshaft 60, a spiral bimetal 61 and a heater 62; the heating sequence controller HS comprises a camshaft 65, a spiral bimetal 66 and a heater 67. The associated cam-actuated control switches forming parts of these sequence controllers will be more fully described hereinafter in reference to the sequence of operation of my improved control system.

The outdoor air cooling evaporators E1, E2, E3 and their associated compressors, C1, C2, C3, and the recirculated air cooling evaporator E4 with its associated compressor C4, are progressively, or sequentially, set into operation by the cooling sequence controller CS and the contactors $C_1 - C_4$ as ambient air temperature in the conditioned space 10 rises above the predetermined desired setting of a "dry bulb temperature" sensor 70 positioned in the space 10. In like manner the recirculated air heating condensers CF2, CF2A and the supplementary electric heating coils 22 and 21, all in the recirculated air duct 13, are sequentially set into operation by the heating sequence controller HS and the contactors $H_1 - H_4$ as room temperature decreases below the desired set point. As well known to those skilled in the art, this may be accomplished by providing the temperature responsive sensor 70 with an electrical bridge circuit which generates an output voltage proportional to dry bulb room temperature. As indicated schematically on the drawing, the signal voltage output of such a sensor is supplied to a suitable converter 71 having a zero to plus 2 volt output proportionately responsive in magnitude to the magnitude of deviation of room temperature above the set point, and a zero to minus 2 volt output proportionately responsive in magnitude to the magnitude of deviation of room temperature below the set point. The positive output, representing a room temperature increase, is supplied to the heater 57 of sequence controller CS which then heats the bimetal 56 in proportion to the magnitude of the positive signal voltage, thereby to displace the camshaft 55 through progressively larger angles as room temperature increases above the set point. In a similar manner the converter 71 provides a zero to minus 2 volt output proportional in magnitude to the magnitude of deviation of room temperature below the desired set point, and the negative output of converter 71 is furnished to the heater 67 in the heating sequence controller HS. The HS camshaft 65 is thus displaced through progressively greater angles proportional to increasing deviation of room temperature below the normal set point.

For progressively energizing the four stages of cooling apparatus and the four stages of heating apparatus, the controllers CS and HS are provided each with four cam-actuated switches. Specifically, the switches 75, 76, 77 and 78 of the controller CS sequentially complete energizing circuits for the actuating coils 45, 46, 47 and 48 of the cooling contactors $C_1 - C_4$. Thus, as room temperature increases progressively above the desired set point the cooling control switches 75, 76, 77, 78, sequentially actuate the cooling contactors $C_1 - C_4$, holding the earlier stage contactors actuated as the higher stage contactors are brought into operation. Through their main contacts 80, 81, 82 and 83 the cooling contactors $C_1 - C_4$ progressively bring the compressors C1, C2, C3 and C4 into operation as room temperature increases more and more above a desired set point.

It will, of course, be understood by those skilled in the art that the several stages of air cooling evaporators, E1 - E4, may be arranged as desired in respect to air supplied to the conditioned space 10. As indicated on the drawing, I prefer to arrange the first three stages of cooling coils, E1, E2, and E3 in the fresh air duct 25 and the final cooling stage E4 in the recirculated air duct 13.

The heating sequence controller HS, through its cam actuated contacts 85, 86, 87 and 88 sequentially energizes the heating contactors $H_1$, $H_2$, $H_3$, $H_4$, thereby sequentially or progressively to bring into operation the air heating condenser section CF2, the heating condenser section CF2A, the electric heating coil 22 and the electric heating coil 21, all positioned in the recirculating air duct 13. It will be noted that by utilizing for the first two stages of heating the sectional refrigerant condenser CF2, CF2A associated with the freezer 12 in the conditioned space 10 heat removed from the freezer by the evaporator EF is recovered by return of that heat to the air in the conditioned space. This is accomplished by the selector valves 14 and 15, actuated respectively by the first and second stage heating contactors $H_1$, $H_2$. The heating contactor $H_1$ through its main contact 90 energizes the selector valve solenoid 14*a*, thereby to disable the freezer condenser CF1 and substitute in its place the first section CF2 of the alternate freezer condenser. The second stage heating contactor $H_2$, through its main contact 91, energizes selector valve solenoid 15*a* to open the valve 15*a*, thereby to bring into operation the freezing condenser section CF2A in the recirculating air duct. The two final stages of heating are brought into operation by the heating contactors $H_3$, $H_4$, respectively. The contactor $H_3$ when actuated closes its contact 92 to energize the supplementary electric heater 22 and the contactor $H_4$ when actuated closes its main contact 93 to energize the supplementary heater 21. The heat generating supplementary heaters 21, 22 may, if desired, be oil or gas burning devices.

For the purpose of minimizing operation of the heating apparatus when the space 10 is unoccupied, as at night, I provide time controlled means for automatically changing the set point of the room thermostat to a lower temperature. The "night set back" means illustrated comprises a timing relay TR having a transfer contact 95 which is connected to insert a series set-back resistor 96 in the output circuit of the temperature sensor 70. The timing relay TR is controlled by a seven day timer having a driving motor 100 and a cam-actuated contact 101 arranged to be open during the day and closed at night. When the contact 101 is closed (i.e. at night) it energizes an actuating winding 102 on the relay TR thereby to pick up the relay from its normal daytime dropped out position.

To prevent unnecessary operation of the cooling apparatus in the night set-back mode the timing relay TR is provided also with a normally closed contact 103 arranged when opened in the unoccupied or nighttime mode to disable the actuating heater 57 in the cooling sequence controller CS. In this manner the cooling contactors $C_1 - C_4$ and the associated air cooling apparatus are normally disabled in the set-back mode.

It is, of course, possible, especially in warm and humid climates, that with cooling apparatus disabled in the night set-back mode the space 10 will become undesirably warm. I prefer, therefore, additionally to provide a room thermostat 105 set at an upper limit of room temperature (i.e. above the daytime set point) and arranged to close contacts 106 in shunt to the cooler disabling contacts 103. Thus, when room temperature attains the relatively high setting of thermostat 105 the disabling effect of the timer contact 103 is cancelled and the cooling sequence controller CS reenabled, i.e. again rendered operable.

The damper motor 27 and the fan motor 20 are arranged respectively, to open the damper 26 in the outside air duct and to drive the fan F continuously in the daytime operating mode. To this end the motors 20 and 27 are energized by a fan contactor F through its main contact 110. The contactor F is actuated by a winding 111 energized in the daytime operating mode through a normally closed contact 112 on the timing relay TR. In order that the fan will operate, a fan relay FRH is energized by the first stage heating contactor $H_1$ through a contact 113 and a fan relay FRC is actuated by a contact 114 on the first stage cooling contactor $C_1$. Through their normally open contacts 115 and 116, respectively, the fan relays FRH and FRC are arranged to shunt the timing relay contact 112 which is open in the nighttime operating mode.

In order to maintain dew point temperature at or below a predetermined selected maximum value, I actuate the dew point sequence controller DS in response to a dew point sensor 120 in the conditioned space. The dew point sensor 120 provides an output voltage signal, as from a bridge circuit. For example output voltage of the sensor 120 may be a positive signal voltage between zero and 2 volts proportional in magnitude to increase above a predetermined set point of absolute moisture content (i.e. weight of water vapor per pound of dry air) in the conditioned space 10. As will appear hereinafter, absolute moisture content determines dew point temperature. The output voltage signal of sensor 120 thus represents the magnitude of dew point temperature increases above a set point. This signal proportionately energizes the heater 62 in the dew point controller DS and thus proportionately turns the camshaft 60, thereby sequentially to close three cam actuated switches 121, 122 and 123. These switches are connected, respectively, to shunt the first three stage cooling switches 75, 76 and 77 on the cooling sequence controller CS. The manner in which the sensor 120 and the dew point controller DS functions to maintain dew point temperature at or below a desired maximum value will be more evident by referring now to the psychrometric chart shown at FIG. 5 of the drawing.

The chart of FIG. 5 shows the relationship of a plurality of variable parameters, or characteristics, of ambient air in a conditioned space at constant barometric pressure. The FIG. 5 chart is drawn for a barometric pressure of 29.92 inches of mercury. On the chart the horizontal abscissa represents dry bulb room temperature and the vertical ordinate represents absolute moisture content, or weight of water vapor per pound of dry air. The arcuate lines are lines of constant relative humidity, with the dew point line, or 100% humidity, constituting the upper left boundary of the chart. The parallel lines of greatest slope extending downwardly and to the right from the dew point line are lines of constant volume per pound of dry air and the parallel lines of least slope extending downwardly to the right from the dew point line are lines of constant wet bulb temperature. It is evident that any two of these characteristics define a point on the chart from which the values of the other characteristics represented may be determined.

Referring now again to FIG. 1, and particularly to the dew point sensor 120, I have indicated schematically that the dew point sensor derives its output representing dew point temperature by combining two input signals, one from a dry bulb thermostat 140, and the other from a humidistat 141. Referring now again to the chart at FIG. 5, it will be clear to those skilled in the art that with dry bulb temperature and humidity at predetermined values, as at 70° and 50% respectively, the wet bulb room temperature will be approximately 58.5° absolute moisture content will be 52 grams per pound of dry air and the dew point temperature will be about 50°. A horizontal line through the ambient air condition thus represented by the intersection of the indicated dry bulb temperature and relative humidity represents constant absolute moisture content and constant dew point temperature.

The apparatus described above and illustrated at FIG. 1, operates in accordance with my invention to maintain dew point temperature at or below a predetermined line of constant dew point temperature as described above. The mode of operation will now be readily understood by those skilled in the art from the following brief description:

Let it be first assumed that the system has been operating in its unoccupied night set-back mode with the power lines L1, L2 energized and the control power switch 40 closed, but with the cooling apparatus disabled by the relay TR. In this mode moisture content and relative humidity are uncontrolled unless the space 10 becomes so excessively warm that the room thermostat 105 re-enables the cooling apparatus.

When the seven day timer motor 100 advances to open its contact 101 the occupied or daytime operating mode is initiated. At this time the timing relay TR drops out, closing its contact 103 to enable the cooling apparatus, transferring its contact 95 to the dropped out position to re-set the room thermostat 70 to its daytime setting, and closing a contact 130 in order to disable the supplementary heaters 21 and 22 for an initial morning warm-up period. The purpose of temporarily disabling the supplementary heaters 21, 22 is to conserve energy by utilizing only the refrigerant cooling condensers CF2, CF2A for heating during the warm-up period.

The timing relay contact 130, when closed in the daytime mode, disables the supplementary heaters 21, 22 through a time delay relay TDR and an associated timing device TD. In the exemplary embodiment the time delay relay TDR comprises a timing motor 131 and a pair of cam-actuated contacts 132, 133, the motor 131 driving a camshaft 134 through a magnetic clutch 135 from an initial starting position through approximately a single revolution to a final locked-out position. When deenergized the camshaft 134 returns automatically to its initial starting position. When the contact 130 of timing relay TR closes, it energizes (i.e. engages) the magnetic clutch 135, thereby to connect camshaft 134 to the motor 131. Simultaneously, the timing relay contact 130 energizes an actuating coil 136 of the timing device TD. When the timing device TD picks up it opens a contact 137 to interrupt the energizing circuits of heating contactors $H_3$ and $H_4$ and closes a contact 138 to energize timing motor 131 and set the camshaft 134 in motion.

As the timing camshaft 134 rotates it first opens a normally closed contact of the cam switch 132 in series with contact 137 and then closes a normally open contact of switch 132 to complete an energizing circuit for the heating contactor $H_3$ through contact 87 of the heating controller HS. The contactor $H_3$ is thereafter operable solely in dependence upon the thermostically controlled contact 87. As the camshaft 134 of the time delay relay TDR further rotates, it opens a normally closed contact of the switch 133, thereby to open the circuit of the timing motor 131, and closes a normally open contact of switch 133 to complete an energizing circuit for heating contactor $H_4$ through the timer contacts 138 and 133 in series with the contact 88 of controller HS. At this point the timing motor 131 is locked out and the heating contactors $H_3$ and $H_4$ are operable solely in dependence upon the operation of their associated HS controller contacts 87, 88.

With the timing relay TR dropped in the daytime occupied mode, the room thermostat is set at a predetermined desired daytime set point, for example, 75°. Assuming that the timing relay TDR has timed out over a predetermined initial start-up interval, as 30 to 60 minutes, the system is in a stable operating condition. If ambient temperature in the conditioned space 10 increases above 75° the cooling evaporators E1, E2, E3, E4 are progressively brought into operation by the cooling contactors $C_1$, $C_2$, $C_3$, $C_4$ respectively, through sequential closure of the cooling controller cam switches 75, 76, 77, 78, respectively. For example, the switch 75 may close at 76°; the switch 76 at 77°, the switch 77 at 78° and the switch 78 at 79° of dry bulb temperature in the space 10. Similarly, if dry bulb temperature in the space 10 decreases below the 75° set point of sensor 70, the heating units CF2, CF2A, 22 and 21 are progressively and sequentially brought into operation by the heating contactors $H_1$, $H_2$, $H_3$, $H_4$, respectively, in response to sequential closure of the heating controller switches 85, 86, 87 and 88, respectively.

Referring now to the chart of FIG. 5, if the dry bulb temperature set point is 75° an increase in dry bulb temperature, for example along a horizontal line representing constant dew point temperature, will bring the cooling apparatus into operation. As the space 10 is cooled by the evaporators E1 – E4, it is also dehumidified by at least some of the evaporators. This is well known to those skilled in the art, so that a return to the set point temperature of 75° will be accompanied by a reduction of moisture content and a consequent reduction in humidity and dew point temperature. Such a reduction is not only permissible but desirable, so that no means are provided for adding moisture to provide a constant relative humidity.

If now the conditioned space 10 experiences a decrease in dry bulb temperature, for example, along a horizontal line representing constant absolute moisture content, the heating apparatus CF2, CF2A, 21 and 22 is progressively brought into operation by the heating contactors $H_1$, $H_2$, $H_3$, $H_4$, respectively, and the room temperature restored to the said point of 75°. During this heating operation absolute moisture content is ordinarily not affected, so that the ambient air condition returns to the desired set point along horizontal line of constant dew point.

If for any reason absolute moisture content of the ambient air in the space 10 is increased, with or without a change in dry bulb temperature, above a predetermined set maximum value, the dew point sensor 120 will initiate operation of the dew point controller DS, thereby progressively to set into operation the cooling evaporators E1, E2, E3 to cool and dehumidify incoming outside air traversing the duct 25. In this manner relatively dry air is supplied to the space 10, thereby to decrease absolute moisture content and dew point temperature.

It will now be noted that if an undesired increase in absolute moisture content and dew point temperature occurs without any decrease in dry bulb room temperature, the consequent operation of cooling apparatus in response to the dew point controller DS will undesirably decrease the dry bulb temperature in the space 10 while effecting the desired decrease in dew point temperature. Such undesired decrease in dry bulb temperature will progressively bring into operation the heating units CF2, CF2A, 22 and 21, thereby to restore the dry bulb room temperature to the desired point without interfering with the reduction of dew point temperature and humidity accomplished by simultaneous operation of the cooling units.

It will now be evident to those skilled in the art that my improved operation of heating and cooling air conditioning apparatus jointly in response to dry bulb room temperature and dew point temperature, without attempting to maintain any predetermined constant relative humidity, has the effect of maintaining dew point temperature at or below a predetermined desired maximum value while maintaining dry bulb room temperature constant and allowing humidity to vary. In this manner undesired condensation of moisture on cold surfaces within a conditioned space is satisfactorily controlled while minimizing the utilization of energy necessary to maintain ambient air within tolerable limits of comfort.

While I have described and illustrated only a preferred embodiment of my invention by way of example, many modifications will occur to those skilled in the art, and I therefore wish to have it understood that I intend in the appended claims to cover all such modifications as fall within the true spirit and scope of my invention.

I claim:

1. In a condition control system for ambient air in an enclosed space containing independently cooled moisture condensing surfaces, first switching means operable when energized to cool said air, second switching means operable when energized to heat said air, means responsive to ambient air temperature above a preselected normal range for energizing said first switching means and responsive to ambient air temperature below said range for energizing said second switching means, means responsive to absolute moisture content of said ambient air in excess of a preselected maximum value, and means operable by said moisture content responsive means for energizing said first switching means independently of said air temperature responsive means and without disabling said second switching means.

2. A condition controlled system according to claim 1 additionally including, mode selector means for changing said preselected normal temperature range between first range limits in an unoccupied mode and second range limits in an occupied mode, and means actuated by said mode selector means for disabling said first switching means in said unoccupied mode.

3. A condition control system according to claim 1 additionally including, mode selector means for changing said preselected normal temperature range between low range limits in an unoccupied mode and higher range limits in an occupied mode, means actuated by said mode selector means for disabling said first switching means in said unoccupied mode, and means responsive to ambient air temperature in said space appreciably above said low range limits for nullifying the effect of said disabling means.

4. A condition control system in accordance with claim 1 wherein said first switching means comprises a first group of contactors progressively actuable increasingly to cool said ambient air, said second switching means comprises a second group of contactors progressively actuable increasingly to heat said ambient air, said temperature responsive means alternatively and progressively energizes said first or second groups of contactors, and said moisture content responsive means includes means for progressively energizing said first group of contactors independently of said temperature responsive means.

5. A condition control system according to claim 1 wherein said first switching means comprises a first group of contactors progressively actuable increasingly to cool said ambient air, said second switching means comprises a second group of contactors progressively actuable increasingly to heat said ambient air, said temperature responsive means includes first and second sequentially actuable switching means for progressively energizing said first and second groups of contactors respectively, and said moisture content responsive means includes third sequentially actuable switching means for progressively energizing said first group of contactors independently of said first and second sequentially actuable switching means.

6. In a system for controlling the condition of ambient air in an enclosed space containing independently controlled refrigerating equipment having cooled moisture condensing surfaces within said space and a refrigerant condenser outside said space, heating means including said refrigerant condenser for transferring heat from said equipment to said ambient air, means including a refrigerant evaporator for cooling said ambient air, first switching means operable when energized to render said evaporator operable to cool said air, second switching means operable when energized to render said condenser operable to heat said air, means responsive to ambient air temperature above a preselected normal range for energizing said first switching means and responsive to ambient air temperature below said range for energizing said second switching means, means responsive to absolute moisture content of said ambient air in excess of a preselected maximum value, and means operable by said moisture content responsive means for energizing said first switching means independently of said air temperature responsive means and without disabling said second switching means.

7. A condition control system according to claim 6 additionally including mode selector means for changing said preselected normal temperature range between low range limits in an unoccupied mode and higher range limits in an occupied mode, and means actuated by said mode selector means for disabling said first switching means.

8. A condition control system according to claim 6 wherein said heating means includes supplemental heat generating means and said first switching means sequentially renders operable said heat transfer condenser and said supplemental heat generating means as said ambient air temperature falls progressively below said normal range.

9. A condition control system according to claim 8 which additionally includes mode selector means for reducing said preselected normal temperature range during preselected daily time intervals, means actuated by said mode selector means for disabling said first switching means, and timing means for temporarily disabling said supplemental heat generating means immediately following each said daily time interval.

10. A condition control system according to claim 8 wherein said refrigerant heat transfer condenser provides at least two sections and selector means controlled by said second switching means renders said sections sequentially operable prior to operation of said supplemental heat generating means.

11. The method for maintaining below a predetermined maximum value the dew point temperature of ambient air in a conditioned space provided with heating and cooling apparatus which comprises, cooling said ambient air when dry bulb temperature of said air exceeds a predetermined normal range, heating said air when dry bulb temperature of said air falls below said normal range, cooling said ambient air independently of said dry bulb temperature whenever absolute moisture content of said air exceeds a predetermined maximum value, and reheating said ambient air if said dry bulb temperature falls below said normal range due to cooling in response to excessive absolute moisture content.

12. The method of claim 11 for conditioning ambient air in a space containing independently controlled refrigerating equipment having a refrigerant condenser outside said space which comprises, utilizing said condenser to furnish at least part of any heat supplied to said ambient air in accordance with the said method.

13. The method of claim 12 wherein said condenser is utilized to heat ambient air withdrawn from said space and recirculated thereto.

14. The method of claim 11 wherein heating of said ambient air is carried out in a recirculated air circuit and cooling of said ambient air is carried out by cooling of outside air supplied to said space.

15. The method of claim 11 which additionally comprises, discretely reducing said normal range of temperature during preselected daily time intervals, and normally disabling said cooling apparatus during said intervals.

16. The method of claim 15 which additionally includes reenabling said cooling apparatus whenever during said time intervals dry bulb temperature of said ambient air exceeds the higher of said normal temperature ranges.

17. In a method according to claim 15 for conditioning a space containing independently controlled refrigerating equipment having a refrigerant condenser outside said space and wherein said heating apparatus includes said condenser and supplemental heat generating apparatus, the method which comprises disabling said supplemental heat generating apparatus during a relatively short warm-up interval immediately following termination of each said daily time intervals.

* * * * *